United States Patent [19]

Dones

[11] Patent Number: 4,910,959

[45] Date of Patent: Mar. 27, 1990

[54] PULSED CATALYTIC SUPERCHARGER SILENCER

[75] Inventor: Raymon P. Dones, El Cerrito, Calif.

[73] Assignee: PULSO Catalytic Superchargers Corporation, Oakland, Calif.

[21] Appl. No.: 256,301

[22] Filed: Oct. 11, 1988

[51] Int. Cl.[4] ..... F02B 33/00

[52] U.S. Cl. ..... 60/280; 60/299; 60/605.1; 123/559.2

[58] Field of Search ..... 60/274, 313, 39.45, 60/723, 280, 605.1, 299; 123/559.2; 417/64; 181/225, 268, 275

[56] References Cited

U.S. PATENT DOCUMENTS

| | | | |
|---|---|---|---|
| 2,957,304 | 10/1960 | Berchtold | 123/559.2 |
| 3,050,375 | 8/1962 | Block . | |
| 3,641,763 | 2/1972 | Cole | 422/180 |
| 3,643,425 | 2/1972 | Kraus . | |
| 3,798,906 | 3/1974 | Woollenweber | 60/598 |
| 3,908,367 | 9/1975 | Bauman | 60/280 |
| 4,056,933 | 11/1977 | Nohira | 60/278 |
| 4,362,223 | 12/1982 | Meier | 181/268 |
| 4,420,933 | 12/1983 | Katitani | 60/302 |
| 4,424,882 | 1/1984 | Moller | 181/268 |
| 4,563,997 | 4/1986 | Aoki | 123/559 |
| 4,702,075 | 10/1987 | Jenny | 60/311 |

FOREIGN PATENT DOCUMENTS

| | | | |
|---|---|---|---|
| 3519543 | 12/1986 | Fed. Rep. of Germany | 123/559.2 |
| 3728189 | 5/1988 | Fed. Rep. of Germany | 123/559.2 |
| 39809 | 11/1971 | Japan | 181/268 |
| 202013 | 8/1923 | United Kingdom | 181/268 |

*Primary Examiner*—Douglas Hart

*Attorney, Agent, or Firm*—Robert R. Tipton

[57] ABSTRACT

A pressure wave supercharger utilizes a rotor having closely spaced conduits in a rectangular array whose inside surfaces are provided with a catalyst for exothermic oxidation of incompletely burned exhaust gases. The size, geometry and length of the conduits are arranged to achieve maximum energy transfer of the sonic velocity exhaust gases and exothermic expansion of those gases in supercharging incoming air to the intake manifold. The spent gases are discharged to the atmosphere with a minimum of sonic energy.

22 Claims, 6 Drawing Sheets

PULSED CATALYTIC SUPERCHARGER SILENCER

BACKGROUND OF THE PRIOR ART

This invention relates generally to pressure wave superchargers for internal combustion engines and in particular to pressure wave superchargers having increased efficiency, emissions control and sound suppression capabilities.

Pressure wave superchargers have been produced, primarily for use on diesel engines, since 1923. The original system utilized a cylindrical rotating member having a plurality of conduits running lengthwise. Exhaust gases from the diesel engine exhaust manifold were directed into one end of the cylinder while incoming fresh air from the air intake vent was directed into the other end of the cylinder.

The fresh air contained in the rotating cylinder conduits was compressed and directed into the air intake manifold of the engine by the high sonic velocity exhaust gases. The exhaust gases were then expelled into the outside atmosphere by the reflected shock wave action of the gases to allow entry into the rotating member of fresh air entering from the air intake vent.

The action of the incident and reflected exhaust gas shock waves were used to compress the air and help expel the exhaust gases before the exhaust gases could pass completely through the rotating member.

In the pressure wave superchargers of the prior art the plurality of conduits forming the rotating member were originally arranged in single ring. This configuration resulted in loud "siren" noises in the 4 kHz range. To help reduce, but not necessarily eliminate, this noise, the cross-sectional area of the conduits were modified and the conduit openings were arranged in two concentric rings and offset to provide half cycle sonic interference.

Because of the large size of the rotating member openings and the relatively high rotational velocity (up to approximately 9,000 RPM) the rotating member was required to be fabricated using expensive centrifugal investment casting methods.

Later improvements were made in the pressure wave supercharger at low engine speeds by provided an independent means for rotating the rotating member.

Further improvements were made to increase operating efficiency for a range of speed by providing gas expansion pockets in the housing proximate the ends of the rotating member.

For the most part, pressure wave superchargers of the prior art were used on diesel engines, rather than gasoline engines, to improve efficiency and increase horsepower.

Their use on gasoline engines, particularly rotary engines, has not been prevalent because of the high engine RPM, high exhaust temperature and noise suppression requirements, when compared with diesel engine operating characteristics. In addition, the current air pollution standards for diesel engines are not as stringent as for gasoline fueled internal combustion engines that might suggest the use of a catalytic converter to process diesel engine exhaust gases.

None of the prior art references appear to have considered the use of the heat of combustion of unburned fuel as a means of augmenting the supercharging of a gasoline fueled internal combustion engine. Nor have the prior art devices considered the use of permanent magnet, direct current electric drive motors to regulate the speed and eliminate the power drain of the rotating member.

SUMMARY OF THE INVENTION

The apparatus of the present invention is an improvement on the prior art pressure wave superchargers for use on an internal combustion engine having an air intake manifold and an exhaust manifold, a generally cylindrical rotating member adapted to rotate about its cylindrical axis comprising an air intake end and an exhaust gas end, in that is comprises, basically, a plurality of closely spaced conduits disposed parallel to the axis of rotation of said cylindrical member fluidly communicating said air intake end with said exhaust gas end, said closely spaced conduits having an inside surface area and an end opening area sufficient to cause high velocity exhaust gases to frictionally engage the conduit walls and to expand due to exothermic catalytic chemical reactions of exhaust gas components to more stable compounds.

The apparatus of the present invention further comprises a housing, having an intake air end and an exhaust gas end, adapted to enclose said generally cylindrical rotating member.

The air intake end comprises a pair of intake air manifold openings disposed approximately 180 degrees to each other in fluid communication with said air intake manifold, and a pair of fresh air intake openings circumferentially adjacent to the intake air manifold opening and having a cross-sectional area greater than the cross-sectional area of the intake manifold openings.

The exhaust gas end comprises a pair of exhaust gas header openings disposed approximately 180 degrees to each other in fluid communication with the exhaust gas manifold and aligned with said pair of air intake manifold openings distal the exhaust gas end of the rotating member, and a pair of exhaust gas outlet openings circumferentially adjacent to the exhaust gas manifold openings and in fluid communication with outside atmosphere.

The generally cylindrical rotating member is adapted to rotate about its cylindrical axis in a direction first exposing the air intake end to the fresh air intake openings and then exposing the air intake end to the pair of intake air manifold openings while simultaneously first exposing the exhaust gas end to the exhaust gas manifold openings and then exposing the exhaust gas end to the outside atmosphere.

To provide generally automatic speed regulation and reduce external drive requirements of the rotating member, the exhaust gases are introduced into the exhaust gas end of rotating member at an angle of approximately 15 degrees to the axis of the rotating member in the direction of rotation.

The pressure wave supercharger of the present invention also comprises a heat exchanger down stream from the pressure wave supercharger for heating by-pass air for injection into the engine exhaust gas manifold to enhance exothermic reaction of the unburned exhaust gases.

It is, therefore, an object of the present invention to provide a pressure wave supercharger for an internal combustion engine.

It is a further object of the present invention to provide a pressure wave supercharger for an internal combustion engine in which the heat from the exothermic reaction of the burning of the unburned exhaust gases is used to increase the efficiency of operation of the pressure wave supercharger.

It is another object of the present invention to provide a pressure wave supercharger in which heated fresh air is provided in the exhaust gases to enhance combustion of the unburned exhaust gases.

It is still another object of the present invention to provide a pressure wave supercharger in which the size and pattern of the plurality of conduits in the rotary member enhance exothermic expansion of exhaust gases and suppress sonic wave noise.

It is yet another object of the pressure wave supercharger of the present invention to expose incoming fresh air to a catalytic material prior to injection into the air intake manifold.

It is still a further object of the present invention to provide a pressure wave supercharger utilizing a catalytic converter material in its rotary member to process incoming fresh air prior to compressing it into the air intake manifold by the supercharger.

It is yet a further object of the present invention to expose both intake air and exhaust gases alternately to the same catalytic converter surface.

It is another object of the present invention to provide a pressure wave supercharger in which intercooling of the exposed intake air up-stream from the supercharger can be used to increase engine efficiency as well as reduced noise.

It is still another object of the present invention to provide a pressure wave supercharger in which the rotary velocity and centrifugal forces on the rotating member are substantially reduced.

It is a further object of the present invention to provide a pressure wave supercharger in which rotation of the rotating member structure can be controlled by the motor-generator torque characteristics of a permanent magnet direct current motor.

It is yet a further object of the present invention to provide a pressure wave supercharger in which intake-air and exhaust noise components can be isolated, attenuated and residuals transferred to the intercooler and intake manifolds where they can be better suppressed.

It is still another object of the present invention to provide a pressure wave supercharger in which the rotational speed of the rotating member is automatically regulated in accordance with engine power to provide optimum performance and reduce drive requirements.

It is a further object of the present invention to provide a pressure wave supercharger in which the rotating member structure is simpler in design and less costly to manufacture.

These and other objects of the present invention will be manifest upon careful study of the following specification and drawings.

DESCRIPTION OF THE PREFERRED EMBODIMENT

Figure 2:
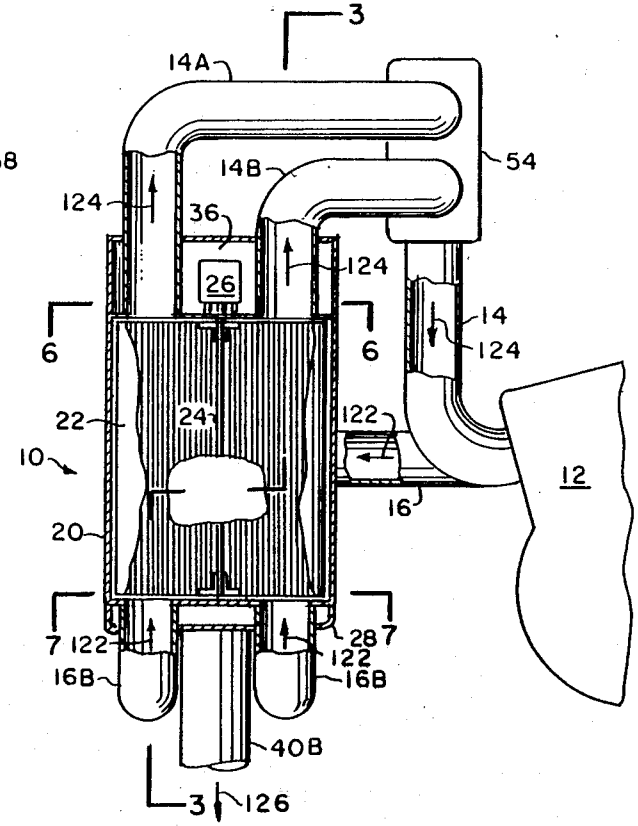
FIG. 2 is a partial cut-away end view of the pressure wave supercharger apparatus of the present invention taken at lines 4—4 of FIG. 1.
Figure 1:
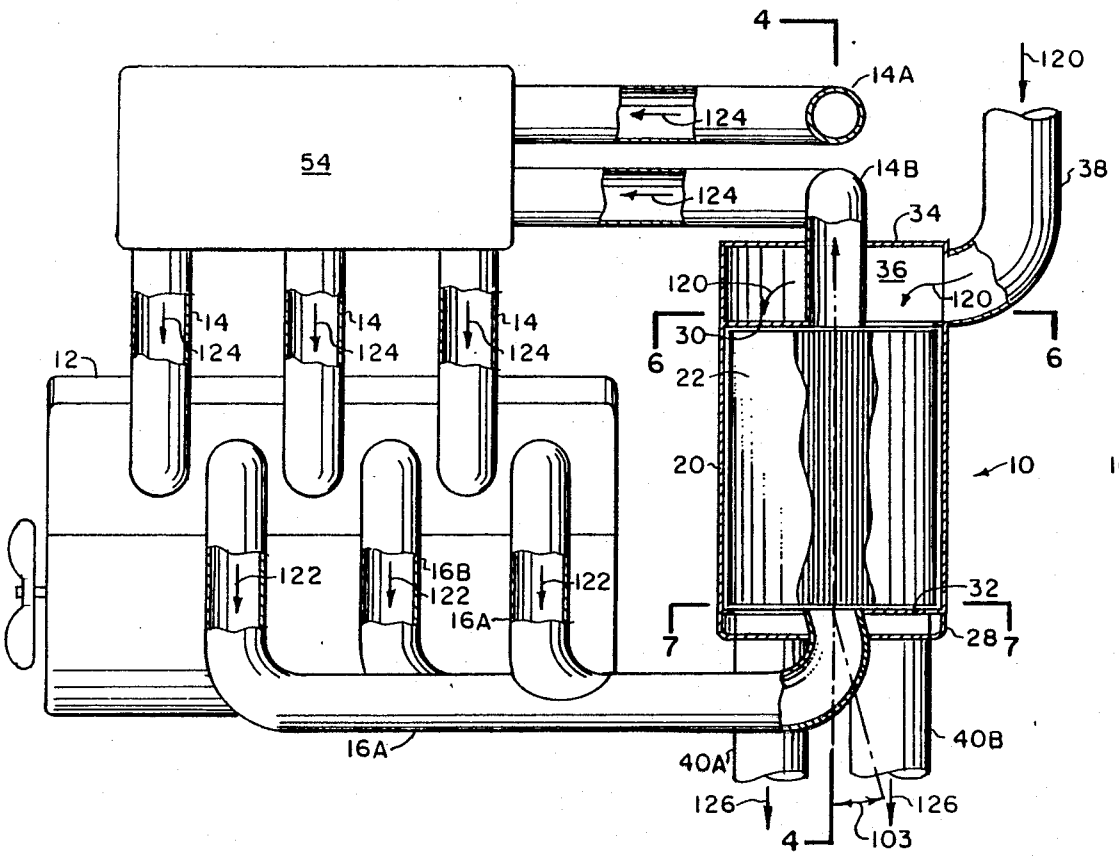
FIG. 1 is a partial cut-away side view of the pressure wave supercharger apparatus of the present invention showing its relationship to the exhaust and intake ports of a gasoline internal combustion engine taken at lines 3—3 of FIG. 2.

Typically, the pressure wave supercharger 10 of the present invention is use in conjunction with an internal combustion engine 12, as shown in FIGS. 1 and 2. Internal combustion engine 12 is a 4-cycle, 6 cylinder, V-type engine (one side shown in FIGS. 1 and 2) common in the art having an intake air manifold 14 and an exhaust manifold 16. Pressure wave supercharger 10 will also perform well on a rotary internal combustion engine or a two-cycle internal combustion engine.

Supercharger 10 comprises, basically, a main housing 20 containing rotating cylindrical member 22 adapted to rotate about central rotor shaft 24, defining the axis of rotation of the cylinder, driven by permanent magnet, direct current electric motor 26, a top plate 30 proximate the upper end of rotating member 22 and a bottom plate 32 proximate the lower end of rotating member 22 with an intake air housing mounted above top plate 30 on top of main housing 20 to define intake air plenum 36. Intake air plenum 36 is adapted to be in fluid communication with both the top of rotating member 22 through top plate 30 and intake air conduit 38. In addition, the two conduits 14A and 14B of intake air manifold 14 are also in fluid communication with the top of rotating member 22 through top plate 30.

The two collectors 16A and 16B of exhaust headers 16 are attached, through bottom housing 28, to bottom plate 32 and are adapted to be in fluid communication with the bottom of rotating member 22 through bottom plate 32. In addition, the two exhaust tail pipes 40A and 40B are also in fluid communication with the bottom of rotating member 22 through bottom plate 32. Bottom housing 28 is connected to rotor housing 20 by means of connector band 29 also enclosing thermal insulation mat 31 and cirumferentially tightened using gear clamps 33A and 33B.

Figure 3:
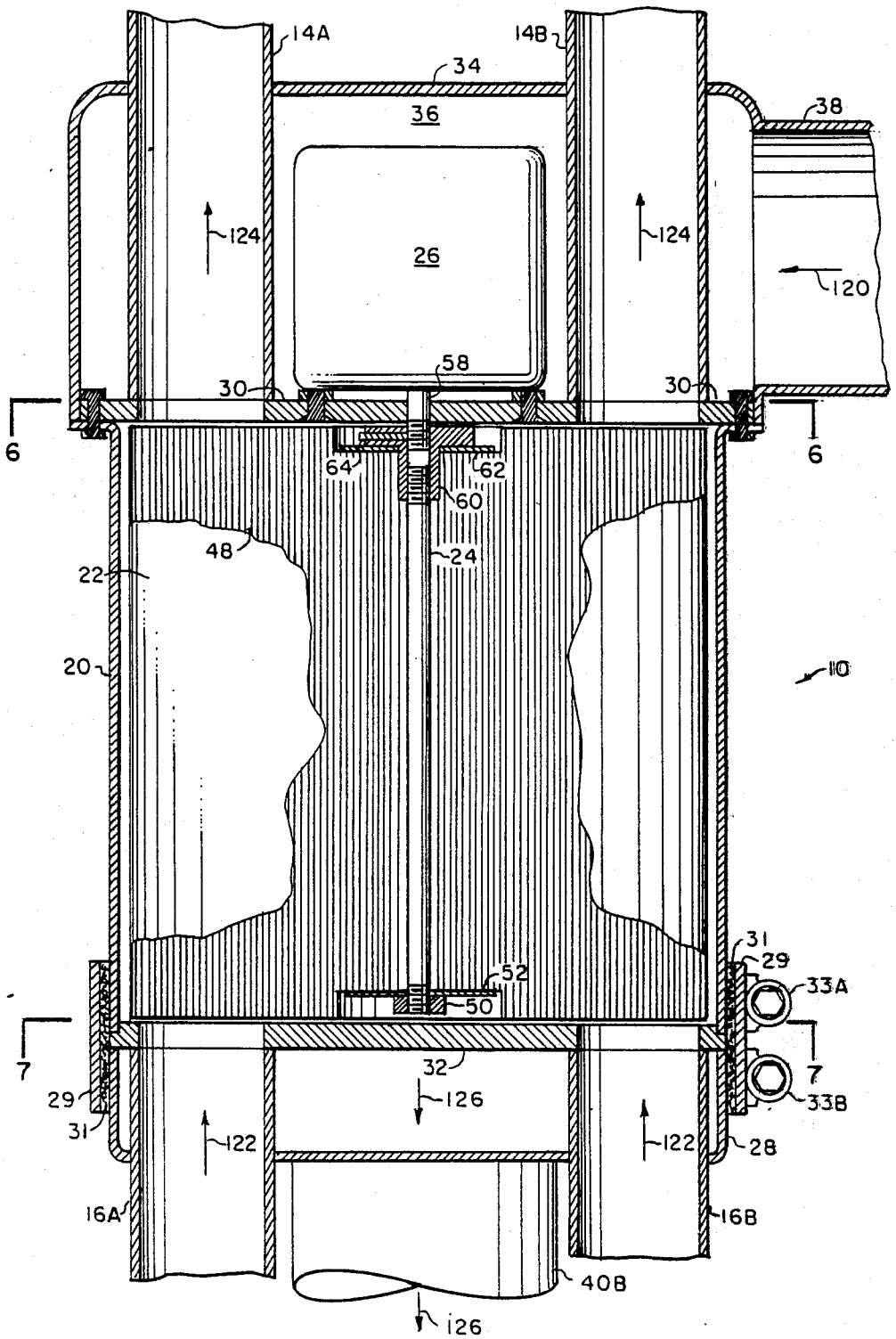
FIG. 3 is a elevational, cross-sectional view of the pressure wave supercharger apparatus of the present invention showing the rotor assembly in greater detail.

With reference to FIG. 3, there is illustrated an elevational, cross-sectional view of the pressure wave supercharger apparatus 10 of the present invention showing the rotating member 22 and housing 20 in greater detail.

The internal structure of rotating member 22 comprises a plurality of parallel channels 48 disposed parallel to the axis of rotation of rotating member 22.

Shaft 24 is connected to rotating member 22 at its bottom end by nut 50 in conjunction with washer 52, with the bottom end of rotating member 22 adjacent above bottom plate 32.

The top end of shaft 24 is connected to shaft 58 of electric motor 26 by means of internally threaded tubing 60 having a flange 62. Threaded tubing 60 is first attached to the top of shaft 24 and tightened to bear against washer 62 so as to provide frictional engagement of shaft 24 with rotating member 22 through nut 50, washer 52, flanged tubing 60 and washer 62. Flanged tubing 60 is attached to shaft 58 of electric motor 26 by means of set screw 64.

It is thus a simple matter to replace rotating member 22 by removing nut 50, sliding rotating member 22 off of shaft 24, sliding a new rotating member back on shaft 24 and securing nut 50 in place.

Both top plate 30 and bottom plate 32 are adapted to have a minimal clearance from the respective ends of rotating member 22.

Figure 4:
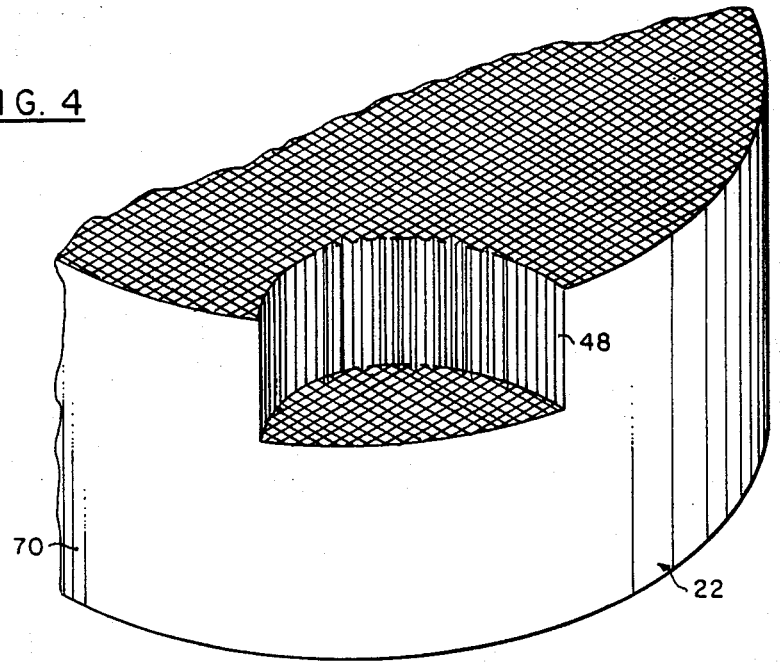
FIG. 4 is an isometric view of the rotor member used in the pressure wave supercharger apparatus of the present invention.

With reference to FIG. 4 there is illustrated an isometric view of rotating member 22 comprising a cylinder having an outer shell housing 70 and containing a plurality of closely spaced generally parallel conduits 48, in rectangular array, open at each end of the rotating member.

Figure 5:
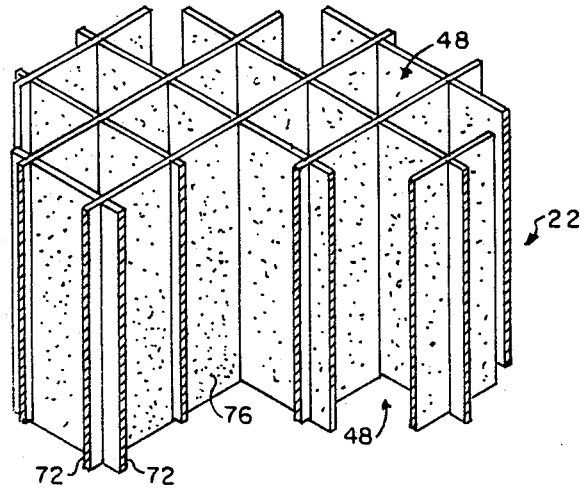
FIG. 5 is an enlarged portion of the rotor member showing the gas flow channels in greater detail.

With reference to FIG. 5 there is illustrated an enlarged section of rotating member 22 showing a plurality of rectangular channels 48 formed by a rectangular lattice of walls 72. Typically, the dimensions of each channel can vary from 0.05 inches to 0.10 inches in width and approximately 6.0 inches in length to provide a length-to-width ratio ranging from 120 to 1 to 60 to 1. This configuration has been found effective to act as a wave guide that substantially attenuates sonic frequency pressure waves above 1,000 KHz.

Although the geometry of channel 48 is shown to be rectangular in the present embodiment, it can also be of other geometries, such as, hexagonal or honeycomb.

It will also be noted that the entire surface of wall 72 is coated with a catalyst substrate 76, such as, platinum, niobium or other rare earth metals, to cause an exothermic chemical reaction within the exhaust gases that will chemically reduce the exhaust products passing into rotating member 22 to a more stable state.

Figure 6:
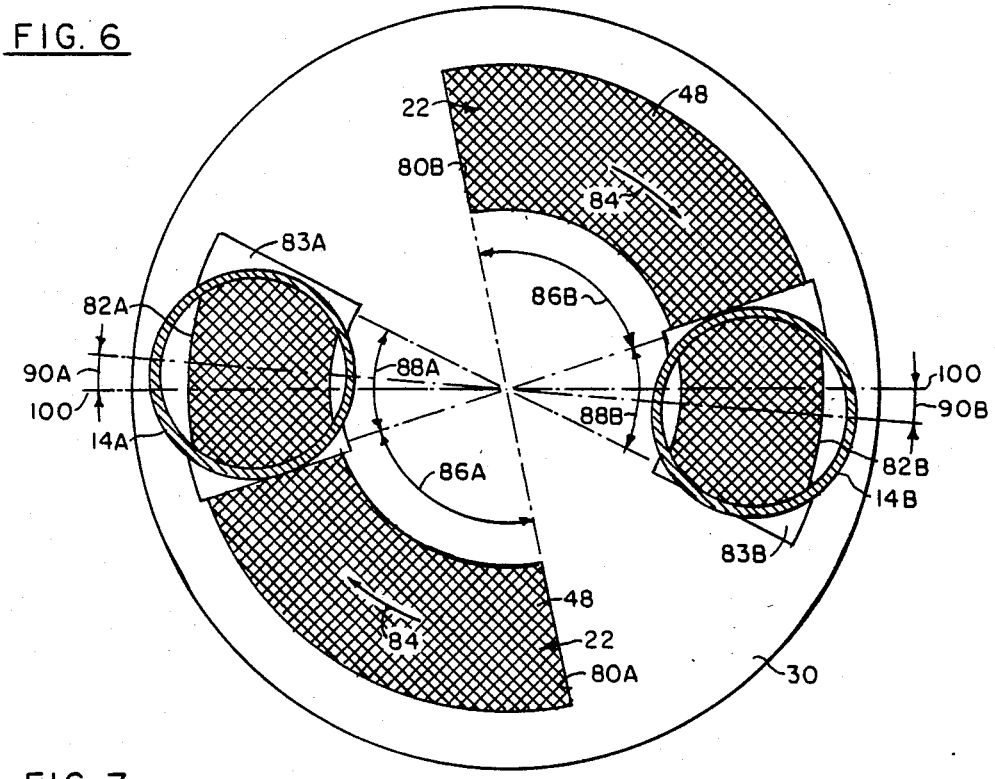
FIG. 6 is a plan view of the intake air top plate of the rotor assembly of the pressure wave supercharger apparatus of the present invention.

With reference to FIG. 6 there is illustrated a plan view of intake air top plate 30 of the rotor assembly 10 taken at lines 6—6 of FIGS. 1, 2 and 3.

Top plate 30 comprises a pair of intake openings 80A and 80B providing fluid communication between intake air plenum 36 and channels 48 at the top end of rotating member 22.

Circumferentially adjacent intake air openings 80A and 80B are air intake manifold openings 82A and 82B, respectively, communicate directly with intake air manifold conduits 14A and 14B, respectively. Transition members 83A and 83B are used to adjust the circular cross-section of conduits 14A and 14B to the partial "pie" shape of openings 82A and 82B.

It will be noted that the direction of rotation of rotating 4 member 22 is indicated as clockwise by arrow 84.

Typically, the angular opening of intake air openings 80A and 80B, as indicated, respectively, by angles 86A and 86B, is approximately 84 degrees while the angular opening of air intake manifold openings 82A and 82B, as indicated, respectively, by angles 88A and 88B, is approximately 42 degrees.

The ratio of these opening represents, roughly, the ratio of compression of intake air by the pressure wave supercharger 10 of the present embodiment.

Figure 7:
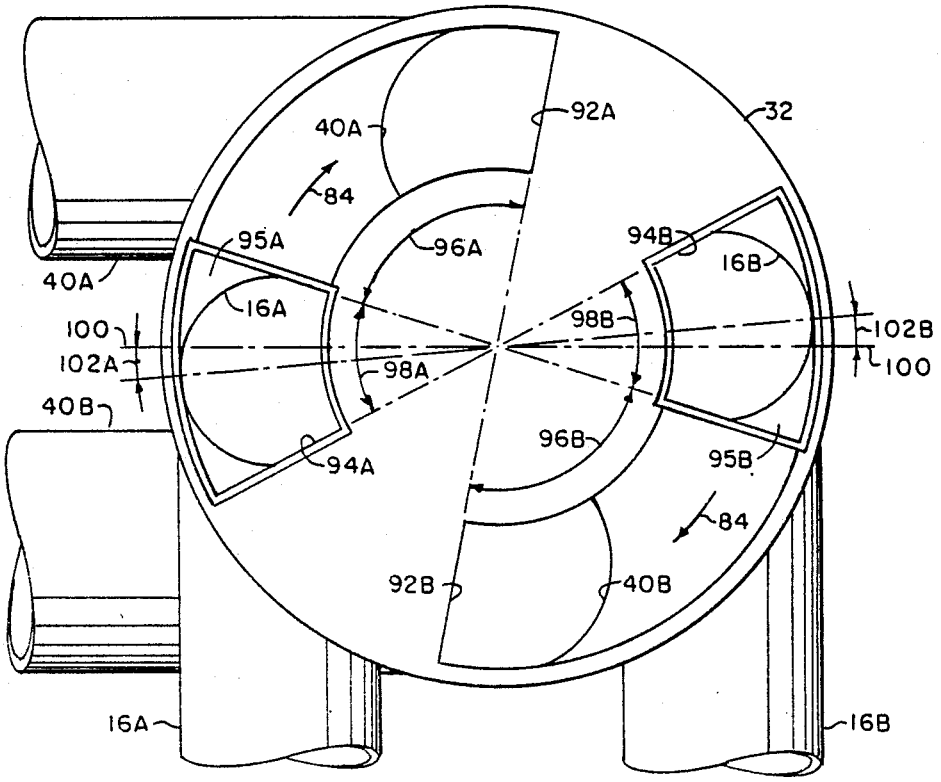
FIG. 7 is a plan view of the exhaust gas bottom plate of the rotor assembly of the pressure wave supercharger apparatus of the present invention.

With reference to FIG. 7 there is illustrated a plan view of exhaust gas bottom plate 32 of the rotor assembly 10 taken at lines 7—7 of FIGS. 1, 2 and 3.

Bottom plate 32 comprises a pair of tail pipe exhaust gas openings 92A and 92B providing fluid communication between channels 48 at the bottom end of rotating member 22 and exhaust tail pipes 40A and 40B, respectively.

Circumferentially adjacent tail pipe exhaust gas openings 92A and 92B are exhaust gas manifold openings 94A and 94B, respectively, providing fluid communication directly from exhaust gas manifold conduits 16A and 16B, respectively, into channels 48 of rotating member 22. Transition members 95A and 95B are used to adjust the circular cross-section of conduits 16A and 16B to the partial "pie" shape of openings 94A and 94B.

It will be noted that the direction of rotation of rotating member 22 is indicated as clockwise by arrow 84, the same direction as shown in FIG. 6.

Typically, the angular opening of tail pipe exhaust gas openings 92A and 92B, as indicated, respectively, by angles 96A and 96B, is approximately 84 degrees while the angular opening of exhaust gas manifold openings 94A and 94B, as indicated, respectively, by angles 98A and 98B, is approximately 42 degrees, the same as the openings in top plate 30.

Although the corresponding openings in top plate 30 and bottom plate 32 are of the same area, it will be noted that the center of intake manifold openings 82A and 82B is offset from base line 100 by an angle 90A and 90B, respectively, of approximately 2.5 degrees in the direction of rotation of rotating member 22.

For bottom plate 32, the center of exhaust gas manifold openings 94A and 94B is offset from base line 100 by an angle 102A and 102B, respectively, of approximately 2.5 degree in a direction opposite to the direction of rotation of rotating member 22.

In other words, openings 82A and 82B in top plate 30 are offset approximate 5 degrees in the direction of rotation of rotating member 22 from openings 94A and 94B, respectively, in bottom plate 32.

This represents the optimum rotational angle for a sonic pressure wave to transit the length of rotating member 22 operating at an optimum rotating speed.

It must also be noted In FIG. 1 that exhaust gas manifolds 16A and 16B, where they are connected to bottom plate 32 are placed at an angle 103 of approximately 75 degrees to the plane of bottom plate 32 and the bottom surface of rotating member 22 in the direction of rotation of rotating member 22. In other words, the longitudinal axis of exhaust manifolds 16A and 16B, acting as a nozzle where they are connected to to bottom plate 32, are set at approximately 15 degrees to the axis of rotation of rotating member 22, in the direction of rotation of rotating member 22, whereby rotating member 22 is assisted in its rotating by virtue of the action of the exhaust gases impinging at an angle against the bottom surface of rotating member 22.

Figure 8:
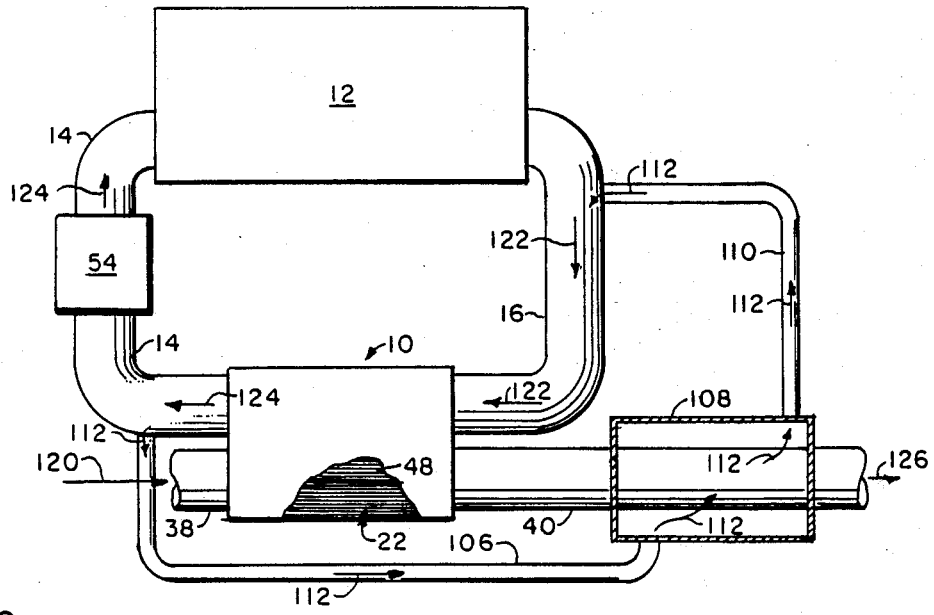
FIG. 8 is a schematic diagram of the pressure wave supercharger or pulsed catalytic supercharger silencer apparatus of the present invention.

Operation:

With reference to FIG. 8 there is illustrated a schematic diagram of pressure wave supercharger 10 in relation to internal combustion engine 12.

Intake air enters supercharger 10 through intake air conduit 38, as indicated by arrow 120, where is compressed in channels 48 of rotating member 22 by the pressure wave from the exhaust gases flowing through exhaust manifold 16 in the direction of arrow 122 into channels 48 at the opposite end of rotating member 22.

As a result, the intake air reverses its direction and is compressed to flow into intake air manifold 14, as indicated by arrows 124, through intercooler 54 and into the various cylinders of internal combustion engine 12.

The spent exhaust gases contained in channels 48 of rotating member 22, after experiencing shear friction and some further expansion due to the exothermic catalytic chemical reaction of the exhaust gases within channels 48, are caused to reverse direction upon their impact with intake air, then, aided by the pressure wave reflected from top plate 30, expand and flow out of channels 48 of rotating member 22 into exhaust gas tail pipe 40 to the atmosphere, as indicated by arrow 126.

Bypass air can also be provided to exhaust gas manifold 16 from intake air conduit 14 through conduit 106, heat exchanger 108 and conduit 110, as indicated by arrow 112.

To fully understand the operation of the pressure wave supercharger 10 of the present invention it must be realized that the exhaust gases emitted by internal combustion engine 12 comprises two types of pressure waves, namely, finite and acoustic wave.

The finite wave is defined as the positive flow pressure wave or pulse traveling at the gas velocity (less than the velocity of sound) through the exhaust gas manifold but with the acoustic wave velocity superimposed on it.

The acoustic wave is defined as that component of the exhaust gas pressure wave traveling at velocity of sound in the exhaust gas at the particular operating exhaust gas temperature.

For the case of a V-6, 4-stroke gasoline engine operating at maximum power production of 4200 RPM or 70 RPSec., the fundamental frequency of the exhaust gas pulses will be approximately 210 Hz. This is just below middle "C" (261.6 Hz) of the musical scale. This would also be the fundamental frequency of the pressure wave pulse. This exhaust gas pressure wave pulse, however is traveling at a velocity ranging up to 25,800 inches per second (ips) at a temperature of approximately 800 degrees C.

The acoustic wave, traveling at the speed of sound through the moving exhaust gases, reaches velocities approximately 5 times the velocity of the finite wave pulses.

The finite pressure wave exhaust gas pulse will retain the elastic characteristics of a compressible gas and will behave according to the laws of fluid mechanics relative to mass and velocity in the subsonic range resulting in its being elastic and having mass, momentum and kinetic energy. When such an elastic gaseous mass collides with and another elastic gaseous mass, there will be a transfer of kinetic energy according the the laws of physics covering the conservation of energy.

The sonic velocity acoustic waves, however, behave in a manner according to the physics of sound waves in that they are diffracted as they pass through other gases of different density but also exchange some of their kinetic energy to the other gas.

In the pressure wave supercharger of the present invention, channels 48 of rotating member 22 tend to act in the manner of waveguides for the acoustic pressure waves. The cross-sectional area and length of the channels have been chosen to substantially attenuate the higher frequency acoustic waves, 1,000 Hz and above, while allowing the lower frequency acoustic wave and finite exhaust gas pressure wave pulses to pass through.

These lower frequency acoustic waves will be somewhat attenuated, however, at their sonic velocity, they will travel the length of channel 48, first through the exhaust gases and then through the intake air gases into the intake air manifold 14, at sonic velocity, and then, if no intercooler is present, through the intake runners into the ports or valves to act like a short-header, short-runner system to increase the pulse energy availability with engine load, torque and speed.

The subsonic pressure wave pulse, however, at the lower frequencies, approximately 210 Hz, will pass into channels 48 at its high, but less than sonic, velocity, to collide with the intake air contained therein having a zero or very low velocity in the opposite direction.

When the exhaust gases, at 800 degrees C., collide with the intake air, at about 0 to 20 degrees C., they will act in the manner of an elastic medium whereby the exhaust gases, having the higher kinetic energy, will tranfer some of that energy to the intake air increasing its temperature, compressing and driving it into air intake manifold 14.

Figure 9:
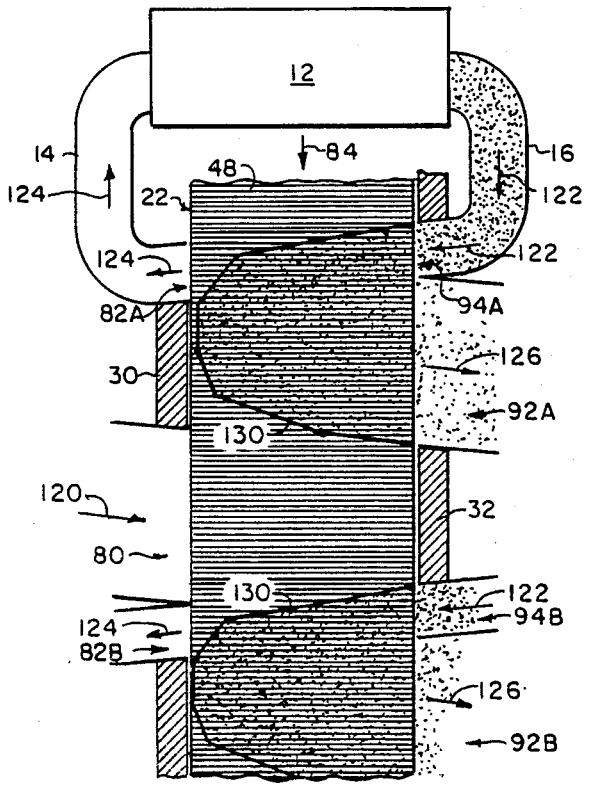
FIG. 9 is an expanded schematic diagram of the flow of intake air and exhaust gases into the pressure wave supercharger or pulsed catalytic supercharger silencer apparatus of the present invention.

With reference to FIG. 9 there is illustrated an expanded or "roll-out" schematic diagram of the flow of intake air and exhaust gases into supercharger 10 showing, in greater detail, the various steps of the process involved in compressing the intake air and expelling the exhaust gases, as if the channels 48 of rotating member 22 were "rolled-out" on a flat surface. In FIG. 9 rotating member 22 is rolled out, so to speak, to show a single compression cycle for intake manifolds 14A and 14B and for exhaust manifolds 16A and 16B involving compression of the intake air, by virtue of flow reversal and subsequent expansion of the exhaust gases and their discharge to the atmosphere.

The direction of rotation of rotating member 22 is indicated by arrow 84 corresponding to the direction of rotation shown in FIGS. 6 and 7. Top plate 30 is represented, schematically, by the vertical wall on the left side of rotating member 22. Bottom plate 32 is represented, schematically, by the vertical wall on the right side of rotating member 22.

With rotating member 22 set to rotate in the direction of arrow 84, air enters channels 48 of rotating member 22 from intake air conduit 38 through opening 80, as indicated by arrow 120, and is carried down and around and back up to air intake manifold 14 opening 82, at which time exhaust gases comprising both finite positive flow and sonic velocity pressure waves, traveling through exhaust gas manifold 16 in the direction of arrow 122, impinge upon the opposite end of rotating member 22 through exhaust manifold opening 94.

The sonic pressure wave, traveling at approximately twice the speed of sound in the cooler intake medium, enters channels 48 causing the charge air to be rapidly expelled under pressure into intake manifold 14 though intake air opening 82 in the direction of arrow 124.

Boundary layer line 130 defines the interface between the fresh intake air and the exhaust gases in channels 48 of rotating member 22. The shaded side to the right of line 130 is intended to depict the exhaust gases within the plurality of channels 48 comprising rotating member 22 as they flow into and out of channels 48.

Figure 10:
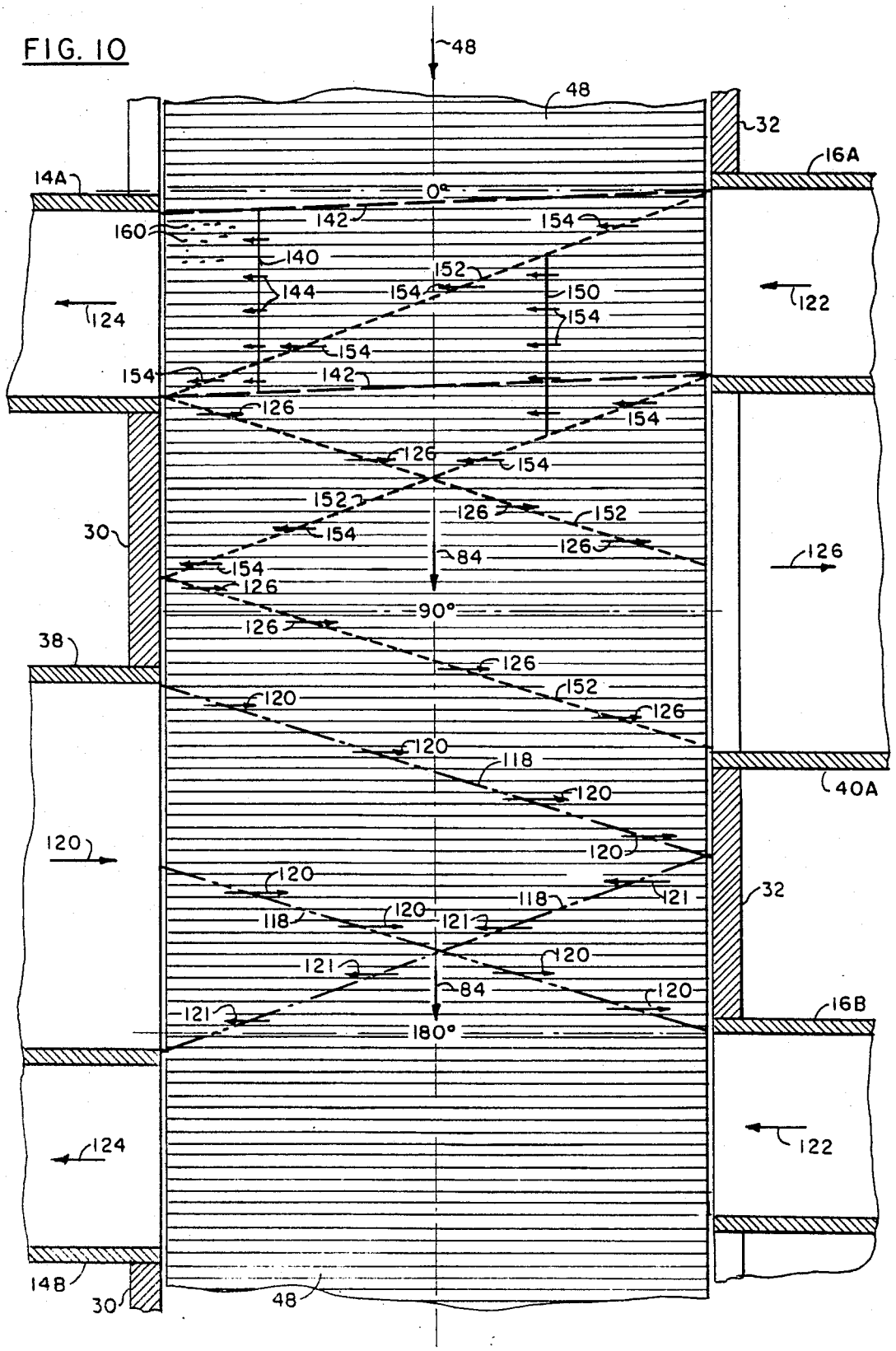
FIG. 10 is an enlarged view of the roll-out schematic diagram of FIG. 9 showing the flow of intake air and exhaust gases in greater detail.

With reference to FIG. 10, there is illustrated an enlarged scale drawing of the diagram of FIG. 9 showing, in greater detail, the paths of the intake air, exhaust gases and the finite and acoustic waves as they enter and leave channels 48 of rotating member 22.

In FIG. 10, the path of a typical sonic or acoustic pressure wave front 140 is indicated by dashed line 142 traveling in the direction indicated by arrow 144.

The path of a typical finite wave front 150 is indicated by dotted line 152 traveling in the direction of arrow 154 as it enters from exhaust manifold 16.

It will be noted that the exhaust gases from manifold 16 enter channels 48 at a temperature of approximately 800 degrees C. and a velocity of up to 25,827 ips. As the exhaust gas transfers a portion of its kinetic and thermal energy to the intake air contained in channels 48, the final velocity of the intake air, as it leaves channels 48 to enter intake air manifold 14 is approximately 15,230 ips at a temperature of 100 degrees C.

By virtue of the rotation of channels 48 in rotating member 22, the exhaust gas flow and the corresponding pressure wave front 150 carried in channels 48 is moved away from intake air opening 82 and caused to be stopped by the flat surface of top plate 30 between air intake opening 80 and air intake manifold opening 82.

Since the exhaust gases are traveling at less than sonic velocity, when the exhaust gas wave front encounters the flat surface of top plate 30, it will behave elastically and be reflected in the opposite direction as indicated by arrows 158.

Concurrently, as the unburned exhaust gases contact catalyst substrate 76 lining the walls of channels 48, some shear friction develops but a further rapid expansion of the gases occurs as a result of the catalytic exothermic chemical reaction reducing prior unburned exhaust gases to a more stable state. The initial reversal, expansion and wave reflection against top plate 30 causes the exhaust gases to flow out of channels 48 into exhaust gas tail pipe 40 as indicated by arrow 126, concurrently with a new charge of intake air entering channels 48 at the opposite end of rotating member 22, as indicated by dashed line 118 and arrows 120 and 121.

With the velocity of gases in rotating member 22 it is possible to allow most of the minute particles of the catalytic-converter substrate metals 160 ablated by the exhaust gases to enter intake manifold 14 to further enhance the combustion process.

Table 1 represents some typical flow rates and temperatures of the intake-air and exhaust gases.

TABLE 1

| | |
|---|---|
| Intake-air Average Flow Rate in Conduit 14 = | 3,816 ips |
| Intake-air Average Temperature = | 100 Degrees C. |
| Exhaust Gas Average Flow Rate in Conduit 16 = | 6,470 ips |
| Exhaust Gas Average Temperature = | 800 Degrees C. |
| Exhaust Gas Average Flow Rate in Conduit 18 = | 3,235 ips |
| Fresh-air Average Flow Rate in Conduit 38 = | 1,654 ips |
| Fresh-air Average Temperature = | 21 Degrees C. |
| Acoustic Wave Velocity in Exhaust Gases = | 25,877 ips |
| Acoustic Wave Velocity in Intake-air = | 15,230 ips |
| Acoustic Wave Velocity of Incoming Fresh Air = | 13,200 ips |

In the present embodiment, rotating member 22 is adapted to rotate at a minimum speed of approximately 2,400 RPM.

It has been discovered that the exhaust gas pressure wave impinges upon the bottom end of rotating member 22 at a velocity ranging to approximately 25,800 inches per second (ips). A portion of this pressure wave energy is reflected back through the open ends of channels 48 of rotating member 22 and intake duct 14 before the exhaust ports of internal combustion engine 12 close thus increasing available energy during the blow-down period and maintaining good scavenging.

With respect to sound attenuation, it has also been found that the size and shape of conduits 48, along with the fiction characteristics of the channel walls, in combination with the use of catalyst substrate 72 on the walls of channels 48, substantially suppress exhaust noises. Because of the acoustic isolation of individual cells, the plane-wave characteristics of the expansion of the gases from the catalytic exothermic chemical reaction, most of the residual noise energy appears to blow into the charge air or intake manifold opening 82 through the core of intercooler 54 and into intake air manifold 14 where further sound attenuation occurs.

Because the gases are accelerated out of channels 48 into tail pipe 40 primarily by the initial expansion of the gases after the catalytic exothermic chemical reaction and reversal of flow direction rather than the reflected pressure wave of the gases, the medium and higher frequency exhaust gas noises have to travel laterally through many adjacent cells 48 to tailpipes 40 and are substantially suppressed.

It has also been found that by using rectangular array of channels 48, having a length to width ratio greater that 60 to 1 and an opening dimension of from 0.10 to 0.05 inches, most of the siren noise resulting from chopping of the gas and air stream at the ends of rotating member 22 are above the audible range of the human ear.

Furthermore, because dual intake and exhaust openings are used with respect to the single rotating member 22, the speed of the rotating member can be reduced by one-half, thereby further substantially reducing any siren noise created by rotating member 22.

This reduction in speed also permits rotating member 22 to operate at substantially lower mechanical stresses. At these low operating stresses, rotating member 22 can thus be fabricated out of a ceramic material rather than metal to further reduce weight and the cost of manufacture.

It has also been found that by mounting exhaust gas manifold pipe 16 at an angle of approximately 15 degrees to the axis of rotation of rotating member 22 (85 degrees to the plane of bottom plate 32 and the bottom surface of rotating member 22) to direct the exhaust gases against channels 48 in the direction of rotation of member 22, the energy requirements for driving rotating member 22 can be substantially reduced or eliminated. Such a configuration will also provide speed regulation of rotating member 22 at varying engine RPM.

By using a permanent magnet direct current motor drive for driving rotating member 22, any surplus energy from the use of this configuration will cause drive motor 26 to act as a generator or a dynamic braking means for controlling rotor RPM.

This configuration has the advantage of automatically controlling the rotating velocity of rotating member 22 to provide optimum performance of pressure wave supercharger 10 of the present invention over a wide range of engine speeds.

What is claimed:

1. A pulsed catalytic converter supercharger silencer for an internal combustion engine comprising an internal combustion engine having an air intake manifold and an exhaust manifold, a generally cylindrical rotating member adapted to rotate about its cylindrical axis comprising
an air intake end,
an exhaust gas end, and
a plurality of closely spaced conduits disposed parallel to the axis of rotation of said cylindrical member fluidly communicating said air intake end with said exhaust gas end, said closely spaced conduits defining wave guides having dimensions sufficient to substantially attenuate sound waves above 1,000 Hz,
means defining a housing adapted to enclose said generally cylindrical rotating member, said housing comprising
an air intake end comprising
means defining an intake air manifold opening in fluid communication with said air intake manifold,
means defining a fresh air intake opening circumferentially adjacent to said intake air manifold opening in fluid communication with outside air,
an exhaust gas end comprising
means defining an exhaust gas manifold opening in fluid communication with said exhaust gas manifold and aligned with said air intake manifold opening distal said exhaust gas end,
means defining an exhaust gas outlet opening circumferentially adjacent to said exhaust gas manifold opening in fluid communication with outside atmosphere,
means for rotating said generally cylindrical rotating member about its cylindrical axis in a direction first exposing said air intake end to said fresh air intake opening and then exposing said air intake end to said intake air manifold openings while simultaneously first exposing said exhaust gas end to said exhaust gas manifold opening and then exposing said exhaust gas end to said outside atmosphere.

2. A pulsed catalytic converter supercharger silencer for an internal combustion engine as claimed in claim 1 wherein said plurality of closely spaced conduits disposed parallel to the axis of rotation of said cylindrical member fluidly communicating said air intake end with said exhaust gas end define wave guides having dimensions sufficient to substantially attenuate sound waves above 1,000 Hz by more than 50 percent.

3. A pulsed catalytic converter supercharger silencer for an internal combustion engine as claimed in claim 1 wherein said plurality of closely spaced conduits disposed parallel to the axis of rotation of said cylindrical member fluidly communicating said air intake end with said exhaust gas end comprise
a plurality of closely spaced conduits have a length to width ratio greater than 96 to 1.

4. The pulsed catalytic supercharger silencer as claimed in claim 1 further comprising
means for injecting exhaust gases against said cylindrical rotating member at an angle to the longitudinal axis of said plurality of closely spaced conduit in the direction of rotation of said rotating member.

5. A pulsed catalytic converter supercharger silencer for an internal combustion engine comprising
an internal combustion engine having an air intake manifold and an exhaust manifold,
a generally cylindrical rotating member adapted to rotate about its cylindrical axis comprising
an air intake end,
an exhaust gas end, and
a plurality of closely spaced conduits disposed parallel to the axis of rotation of said cylindrical member fluidly communicating said air intake end with said exhaust gas end, said closely spaced conduits defining wave guides having dimensions sufficient to substantially attenuate sound waves above 1,000 Hz,
means defining a housing adapted to enclose said generally cylindrical rotating member, said housing comprising
an air intake end comprising
means defining an intake air manifold opening in fluid communication with said air intake manifold,
means defining a fresh air intake opening circumferentially adjacent to said intake air manifold opening in fluid communication with outside air,
an exhaust gas end comprising
means defining an exhaust gas manifold opening in fluid communication with said exhaust gas manifold and aligned with said air intake manifold opening distal said exhaust gas end,
means defining an exhaust gas outlet opening circumferentially adjacent to said exhaust gas manifold opening in fluid communication with outside atmosphere,
means for rotating said generally cylindrical rotating member about its cylindrical axis in a direction first exposing said air intake end to said fresh air intake opening and then exposing said air intake end to said intake air manifold openings while simultaneously first exposing said exhaust gas end to said exhaust gas manifold opening and then exposing said exhaust gas end to said outside atmosphere.

6. A pulsed catalytic converter supercharger silencer for an internal combustion engine as claimed in claim 5 wherein said plurality of closely spaced conduits disposed parallel to the axis of rotation of said cylindrical member fluidly communicating said air intake end with said exhaust gas end define wave guides having dimensions sufficient to substantially attenuate sound waves above 1,000 Hz by more than 50 percent.

7. A pulsed catalytic converter supercharger silencer for an internal combustion engine as claimed in claim 5 wherein said plurality of closely spaced conduits disposed parallel to the axis of rotation of said cylindrical member fluidly communicating said air intake end with said exhaust gas end comprise
a plurality of closely spaced conduits have a length to width ratio greater than 60 to 1.

8. The pulsed catalytic supercharger silencer as claimed in claim 5 further comprising
means for injecting exhaust gases against said cylindrical rotating member at an angle to the longitudinal axis of said plurality of closely spaced conduit in the direction of rotation of said rotating member.

9. A pulsed catalytic converter supercharger silencer for an internal combustion engine comprising
an internal combustion engine having an air intake manifold and an exhaust manifold,
a generally cylindrical rotating member adapted to rotate about its cylindrical axis comprising
an air intake end,
an exhaust gas end, and
a plurality of closely spaced conduits disposed parallel to the axis of rotation of said cylindrical member fluidly communicating said air intake end with said exhaust gas end, said closely spaced conduits defining wave guides having dimensions sufficient to substantially attenuate sound waves above 1,000 Hz, the inside surface of said closely spaced conduits comprising means for exothermically converting toxic exhaust gases into less-toxic exhaust gases, means defining a housing adapted to enclose said generally cylindrical rotating member, said housing comprising an air intake end comprising means defining a pair of intake air manifold openings disposed approximately 180 degrees to each other in fluid communication with said air intake manifold, means defining a pair of fresh air intake openings circumferentially adjacent to said intake air manifold opening and disposed approximately 180 degrees to each other and in fluid communication with outside air, an exhaust gas end comprising means defining a pair of exhaust gas manifold openings disposed approximately 180 degrees to each other in fluid communication with said exhaust gas manifold and aligned with said pair of air intake manifold openings distal said exhaust gas end, means defining a pair of exhaust gas outlet openings circumferentially adjacent to said exhaust gas manifold openings and disposed approximately 180 degrees to each other and in fluid communication with outside atmosphere, means for rotating said generally cylindrical rotating member about its cylindrical axis in a direction first exposing said air intake end to said fresh air intake openings and then exposing said air intake end to said pair of intake air manifold openings while simultaneously first exposing said exhaust gas end to said exhaust gas manifold opening and then exposing said exhaust gas end to said outside atmosphere.

10. A pulsed catalytic converter supercharger silencer for an internal combustion engine as claimed in claim 9 wherein said plurality of closely spaced conduits disposed parallel to the axis of rotation of said cylindrical member fluidly communicating said air intake end with said exhaust gas end define wave guides having dimensions sufficient to substantially attenuate sound waves above 1,000 Hz by more than 50 percent.

11. A pulsed catalytic converter supercharger silencer for an internal combustion engine as claimed in claim 9 wherein said plurality of closely spaced conduits disposed parallel to the axis of rotation of said cylindrical member fluidly communicating said air intake end with said exhaust gas end comprise a plurality of closely spaced conduits have a length to width ratio greater than 96 to 1.

12. The pulsed catalytic supercharger silencer as claimed in claim 9 further comprising means for injecting exhaust gases against said cylindrical rotating member at an angle to the longitudinal axis of said plurality of closely spaced conduit in the direction of rotation of said rotating member.

13. A pulsed catalytic converter supercharger silencer for an internal combustion engine comprising an internal combustion engine having an air intake manifold and an exhaust manifold, a generally cylindrical rotating member adapted to rotate about its cylindrical axis comprising an air intake end, an exhaust gas end, and a plurality of closely spaced conduits disposed parallel to the axis of rotation of said cylindrical member fluidly communicating said air intake end with said exhaust gas end, the inside surface of said closely spaced conduits comprising means for exothermically converting toxic exhaust gases into less-toxic exhaust gases, said closely spaced conduits having an inside surface area and an end opening area sufficient to cause high velocity exhaust gases to frictionally engage the conduit walls and to expand due to exothermic catalytic chemical reactions of exhaust gas components to more stable compounds, means defining a housing adapted to enclose said generally cylindrical rotating member, said housing comprising an air intake end comprising means defining a pair of intake air manifold openings disposed approximately 180 degrees to each other in fluid communication with said air intake manifold, means defining a pair of fresh air intake openings circumferentially adjacent to said intake air manifold openings and disposed approximately 180 degrees to each other and in fluid communication with outside air, an exhaust gas end comprising means defining a pair of exhaust gas manifold openings disposed approximately 180 degrees to each other in fluid communication with said exhaust gas manifold and aligned with said pair of air intake manifold openings distal said exhaust gas end, means defining a pair of exhaust gas outlet openings circumferentially adjacent to said exhaust gas manifold openings and disposed approximately 180 degrees to each other and in fluid communication with outside atmosphere, means for rotating said generally cylindrical rotating member about its cylindrical axis in a direction first exposing said air intake end to said fresh air intake openings and then exposing said air intake end to said pair of intake air manifold openings while simultaneously first exposing said exhaust gas end to said exhaust gas manifold opening and then exposing said exhaust gas end to said outside atmosphere comprising means for injecting exhaust gases from said exhaust gas manifold against said cylindrical rotating member at an angle to the longitudinal axis of said plurality of closely spaced conduit in the direction of rotation of said rotating member, and means connected to said rotor for initiating rotary motion of said rotor and for preventing said rotor from exceeding a predetermined rotational speed.

14. The pulsed catalytic supercharger silencer for an internal combustion engine as claimed in claim 13 wherein said means connected to said rotor for initiating rotary motion of said rotor and for preventing said rotor from exceeding a predetermined rotational speed comprises and electrical power source, a permanent magnet direct current motor mechanically connected to said rotor and electrically connected to said electrical power source.

15. In a pressure wave supercharger comprising an internal combustion engine having an air intake manifold and an exhaust manifold, a generally cylindrical rotating member enclosed in a housing comprising
an air intake end comprising
means defining an intake air manifold opening in fluid communication with said air intake manifold,
means defining a fresh air intake openings cirumferentially adjacent to said intake air manifold opening in fluid communication with outside air,
an exhaust gas end comprising
means defining an exhaust gas manifold opening in fluid communication with said air intake manifold and aligned with said air intake manifold opening distal said exhaust gas end,
means defining an exhaust gas outlet opening circumferentially adjacent to said exhaust gas manifold opening and in fluid communication with outside atmosphere,
means for rotating said generally cylindrical rotating member about its cylindrical axis in a direction first exposing said air intake end to said fresh air intake opening and then exposing said air intake end to said intake air manifold opening while simultaneously first exposing said exhaust gas end to said exhaust gas manifold opening and then exposing said exhaust gas end to said outside atmosphere,
wherein the improvement comprises
said rotating member comprises
an air intake end,
an exhaust gas end, and
a plurality of closely spaced conduits disposed parallel to the axis of rotation of said cylindrical member fluidly communicating said air intake end with said exhaust gas end,
the inside surface of said closely spaced conduits comprising means for exothermically converting toxic exhaust gases into less-toxic exhaust gases,
said closely spaced conduits having an inside surface area and an end opening area sufficient to cause high velocity exhaust gases to frictionally engage the conduit walls and to expand due to exothermic catalytic chemical reactions of exhaust gas components to more stable compounds,
means for injecting exhaust gases from said exhaust gas manifold against said cylindrical rotating member at an angle to the longitudinal axis of said plurality of closely spaced conduit in the direction of rotation of said rotating member, and
means connected to said rotor for initiating rotary motion of said rotor and for preventing said rotor from exceeding a predetermined rotational speed.

16. The pulsed catalytic supercharger silencer for an internal combustion engine as claimed in claim 15 wherein said means connected to said rotor and initiating rotary motion of said rotor and for preventing said rotor from exceeding a predetermined rotational speed comprises
and electrical power source,
a permanent magnet direct current motor mechanically connected to said rotor and electrically connected to said electrical power source.

17. In a pressure wave supercharger comprising
an internal combustion engine having an air intake manifold and an exhaust manifold,
a generally cylindrical rotating member enclosed is a housing comprising
an air intake end comprising
means defining an intake air manifold opening in fluid communication with said air intake manifold,
means defining a fresh air intake openings circumferentially adjacent to said intake air manifold opening in fluid communication with outside air,
an exhaust gas end comprising
means defining an exhaust gas manifold opening in fluid communication with said exhaust gas end and aligned with said air intake manifold opening distal said exhaust gas end,
means defining an exhaust gas outlet opening circumferentially adjacent to said exhaust gas manifold opening in fluid communication with outside atmosphere,
means for rotating said generally cylindrical rotating member about its cylindrical axis in a direction first exposing said air intake end to said fresh air intake opening and then exposing said air intake end to said intake air manifold opening while simultaneously first exposing said exhaust gas end to said exhaust gas manifold opening and then exposing said exhaust gas end to said outside atmosphere,
wherein the improvement comprises
said rotating member comprises
an air intake end,
an exhaust gas end, and
a plurality of closely spaced conduits disposed parallel to the axis of rotation of said cylindrical member fluidly communicating said air intake end with said exhaust gas end, said closely spaced conduits having a length to width ratio greater than 96 to 1,
the inside surface of said closely spaced conduits comprising means for exothermically converting toxic exhaust gases into less-toxic exhaust gases.

18. The pulsed catalytic supercharger silencer as claimed in claim 17 further comprising
means for injecting exhaust gases against said cylindrical rotating member at an angle to the longitudinal axis of said plurality of closely spaced conduit in the direction of rotation of said rotating member.

19. In a pressure wave supercharger comprising
an internal combustion engine having an air intake manifold and an exhaust manifold, a generally cylindrical rotating member enclosed is a housing comprising
an air intake end comprising
means defining an intake air manifold opening in fluid communication with said air intake manifold,
means defining a fresh air intake openings circumferentially adjacent to said intake air manifold opening in fluid communication with outside air,
an exhaust gas end comprising
means defining an exhaust gas manifold opening in fluid communication with said exhaust gas end and aligned with said air intake manifold opening distal said exhaust gas end,
means defining an exhaust gas outlet opening circumferentially adjacent to said exhaust gas manifold opening in fluid communication with outside atmosphere,
means for rotating said generally cylindrical rotating member about its cylindrical axis in a direction first exposing said air intake end to said fresh air intake opening and then exposing said air intake end to said intake air manifold opening while simultaneously first exposing said exhaust gas end to said exhaust gas manifold opening and then exposing said exhaust gas end to said outside atmosphere,
wherein the improvement comprises
said rotating member comprises an air intake end, an exhaust gas end, and a plurality of closely spaced conduits disposed parallel to the axis of rotation of said cylindrical member fluidly communicating said air intake end with said exhaust gas end, said closely spaced conduits placed in an ordered rectangular array, the inside surface of said closely spaced conduits comprising means for exothermically converting toxic exhaust gases into less-toxic exhaust gases.

20. The pulsed catalytic supercharger silencer as claimed in claim 19 further comprising means for injecting exhaust gases against said cylindrical rotating member at an angle to the longitudinal axis of said plurality of closely spaced conduit in the direction of rotation of said rotating member.

21. In a pressure wave supercharger comprising an internal combustion engine having an air intake manifold and an exhaust manifold, a generally cylindrical rotating member enclosed in a housing comprising an air intake end comprising means defining an intake air manifold opening in fluid communication with said air intake manifold, means defining a fresh air intake openings circumferentially adjacent to said intake air manifold opening in fluid communication with outside air, an exhaust gas end comprising means defining an exhaust gas manifold opening in fluid communication with said air intake manifold and aligned with said air intake manifold opening distal said exhaust gas end, means defining an exhaust gas outlet opening circumferentially adjacent to said exhaust gas manifold opening and in fluid communication with outside atmosphere, means for rotating said generally cylindrical rotating member about its cylindrical axis in a direction first exposing said air intake end to said fresh air intake opening and then exposing said air intake end to said intake air manifold opening while simultaneously first exposing said exhaust gas end to said exhaust gas manifold opening and then exposing said exhaust gas end to said outside atmosphere, wherein the improvement comprises said rotating member comprises an air intake end, an exhaust gas end, and a plurality of closely spaced conduits disposed parallel to the axis of rotation of said cylindrical member fluidly communicating said air intake end with said exhaust gas end, means for injecting exhaust gases from said exhaust gas manifold against said cylindrical rotating member at an angle to the longitudinal axis of said plurality of closely spaced conduit in the direction of rotation of said rotating member, and means connected to said rotor and initiating rotary motion of said rotor and for preventing said rotor from exceeding a predetermined rotational speed.

22. The pulsed catalytic supercharger silencer for an internal combustion engine as claimed in claim 16 wherein said means connected to said rotor for initiating rotary motion of said rotor and for preventing said rotor from exceeding a predetermined rotational speed comprises and electrical power source, a permanent magnet direct current motor mechanically connected to said rotor and electrically connected to said electrical power source.

* * * * *